US005775622A

United States Patent [19]

Jürgens et al.

[11] Patent Number: 5,775,622

[45] Date of Patent: Jul. 7, 1998

[54] WARP REELING SYSTEM

[75] Inventors: Eduard Jürgens, Wegberg; Ralf Fuchs, Stolberg; Joachim Beckers, Mönchengladbach, all of Germany

[73] Assignee: Sucker-Muller-Hacoba GmbH & Co., Monchen-Gladbach, Germany

[21] Appl. No.: 730,956

[22] Filed: Oct. 16, 1996

[30] Foreign Application Priority Data

Oct. 16, 1995 [DE] Germany ..... 195 38 478.4

[51] Int. Cl.[6] ..... B65H 23/198

[52] U.S. Cl. ..... 242/413.5; 242/535; 28/194

[58] Field of Search ..... 242/413.3, 413.4, 242/413.5, 413.6, 535, 535.3; 28/194

[56] References Cited

U.S. PATENT DOCUMENTS

| | | | |
|---|---|---|---|
| 3,279,719 | 10/1966 | Kabelitz et al. | 242/413.4 |
| 4,890,368 | 1/1990 | Schewe | 28/194 |
| 4,966,333 | 10/1990 | Bosch | 242/413.5 |

FOREIGN PATENT DOCUMENTS

| | | | |
|---|---|---|---|
| 1286367 | 1/1969 | Germany | 242/413.4 |
| 21 30 020 | 12/1975 | Germany . | |
| 31 43 054 A1 | 5/1983 | Germany . | |
| 35 37 268 A1 | 4/1987 | Germany . | |
| 39 32 385 A1 | 4/1990 | Germany . | |

*Primary Examiner*—John M. Jillions
*Attorney, Agent, or Firm*—Herbert Dubno; Andrew Wilford

[57] ABSTRACT

A warp formed of a multiplicity of parallel filaments is wound on a warp beam by an apparatus having a supply of the warp, a transport roller, and an adjustment roller adjacent the transport roller and movable between a holding position engaging the transport roller and a winding position spaced therefrom. The warp extends from the supply along a path around the transport roller, hen around the adjustment roller, and then around the warp beam. The beam and transport roller are rotated to displace the warp along the path and wind it up on the beam while maintaining the adjustment roller in the winding position. Tension is detected in the warp at least during winding of the warp on the beam and the adjustment roller is displaced during winding of the warp on the beam in a predetermined first direction transverse to the path to increase and decrease the tension to maintain the tension within a predetermined range when the adjustment roller is not in the holding position. The beam and transport roller are arrested to stop winding of the warp and the adjustment roller is pressed in a second direction transverse to the first direction against the transport roller into the holding position to stabilize the stopped warp.

8 Claims, 1 Drawing Sheet

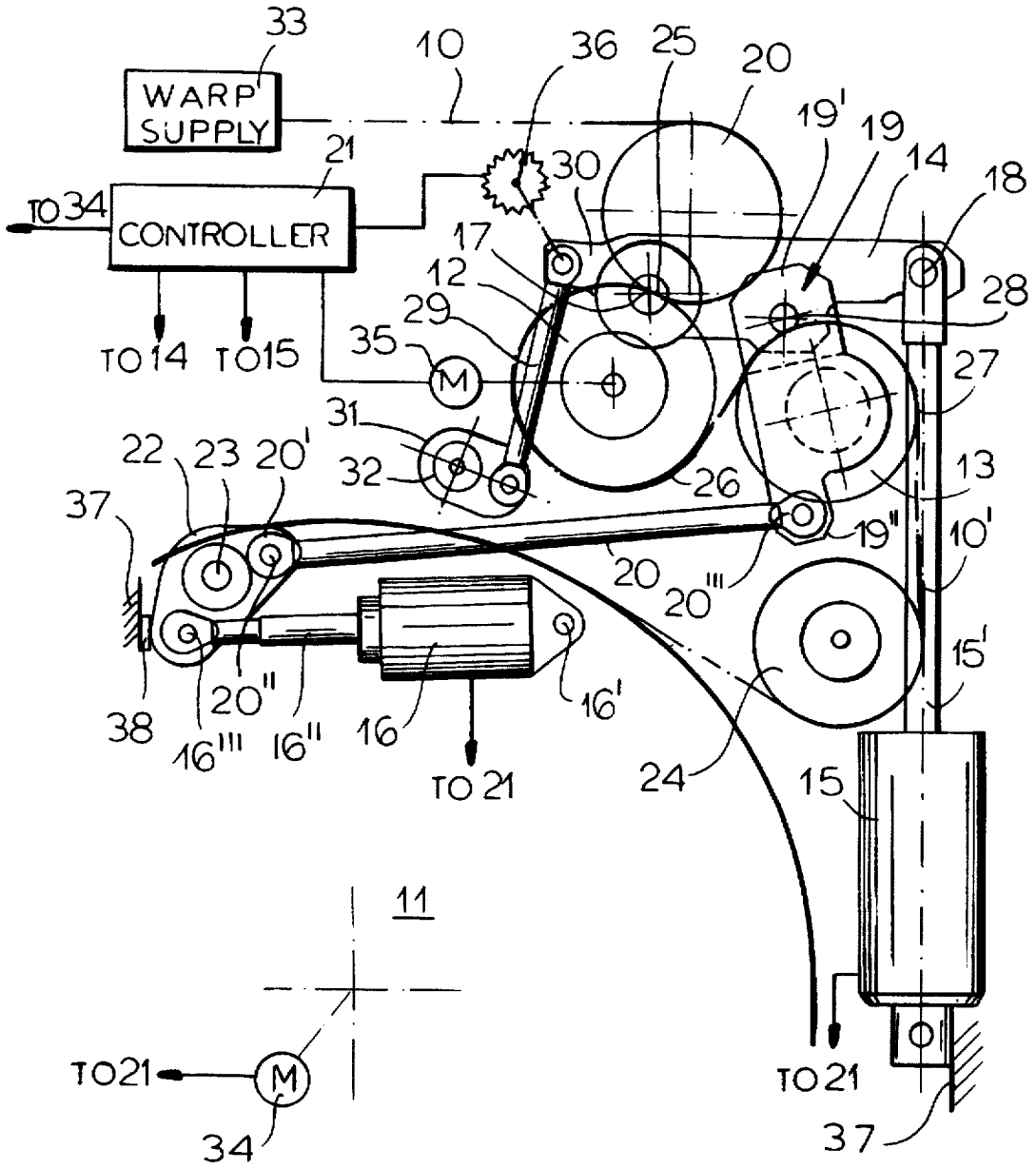
WARP SUPPLY
CONTROLLER
TO 34
TO 14
TO 15
TO 21
TO 21
TO 21
M
M
10
10'
11
12
13
14
15
15'
16
16'
16''
16'''
17
18
19
19'
19''
20
20'
20''
20'''
21
22
23
24
25
26
27
28
29
30
31
32
33
34
35
36
37
37
38

WARP REELING SYSTEM

FIELD OF THE INVENTION

The present invention relates to a warp reeling system. More particularly this invention concerns a method of and apparatus for winding a warp up on a warp beam.

BACKGROUND OF THE INVENTION

In a standard reeling system such as described in commonly owned German patent 3,537,268 filed 19 Oct. 1985 by G. Adler the warp which is formed of a multiplicity of parallel and coplanar warp filaments is pulled from a creel or supply and passes first between a pinch roller and a transport roller, then around an adjustment roller. The transport roller is normally rubber covered and the warp passes through more than 180° around it. This roller is typically operated at a predetermined constant speed to pull the warp from the supply. The warp beam is also driven, but since the warp being wound thereon is constantly increasing in volume, its angular speed must be varied to keep its peripheral speed as close as possible to that of the adjustment roller.

No matter how carefully the system is set up and operated there will inevitably be some variation in the tension in the warp. If the tension is too high, the warp filaments can be stretched or even broken. If it is too low the filaments can cross each other and create tangles that make the warp unusable. Thus the adjustment roller is made movable in a direction transverse to the path so that, if the tension drops, it can move out to lengthen the path and increase the tension and, if the tension increases, it can move in to shorten the path and decrease the tension.

In addition when the warp beam is full it is necessary to stop the apparatus, cut through the warp close to the beam, and switch the full beam with an empty one. After attachment of the freshly created free end to the new empty beam, winding is restarted. During this time it is standard to press the adjustment roller against the stationary transport roller so that the warp is held in place thereon at two angularly spaced pinch locations. This is described in German patent 2,130,020 filed 18 Jun. 1971 and 3,143,054 filed 30 Oct. 1981 by G. Alder.

Once the free end has been attached to the new empty warp beam, rotation of the warp beam and transport roller are restarted. Then the adjustment roller is moved back away from the transport roller and, once it assumes its normal position, it can be displaced to adjust tension.

The problem with this system is that during restart of the system there are frequently yarn breakages. Only once the adjustment roller reaches its normal position can it reassume its tension-regulating function, and in the brief time after rotation is recommenced and before this position is reached, the tension can vary such that it is sufficient to cause a problem.

OBJECTS OF THE INVENTION

It is therefore an object of the present invention to provide an improved warp-winding system.

Another object is the provision of such an improved warp-winding system which overcomes the above-given disadvantages, that is which avoids excessive fluctuations in warp tension even during the critical restart time.

SUMMARY OF THE INVENTION

A warp formed of a multiplicity of parallel filaments is wound on a warp beam by an apparatus having a supply of the warp, a transport roller, and an adjustment roller adjacent the transport roller and movable between a holding position engaging the transport roller and a winding position spaced therefrom. The warp extends from the supply along a path around the transport roller, then around the adjustment roller, and then around the warp beam. The beam and transport roller are rotated to displace the warp along the path and wind it up on the beam while maintaining the adjustment roller in the winding position. Tension is detected in the warp at least during winding of the warp on the beam and the adjustment roller is displaced during winding of the warp on the beam in a predetermined first direction transverse to the path to increase and decrease the tension to maintain the tension within a predetermined range when the adjustment roller is not in the holding position. The beam and transport roller are arrested to stop winding of the warp and the adjustment roller is pressed in a second direction transverse to the first direction against the transport roller into the holding position to stabilize the stopped warp.

Normally the adjustment roller is also displaced in the first direction when the adjustment roller is in the holding position. In addition the transport roller is rotated at a generally constant speed during winding of the warp on the beam, and a rotation speed of the beam is varied in accordance with the output. Presuming that the first actuator presses the adjustment roller against the warp with a constant force, the position of the adjustment roller can be monitored to determine the tension in the web. Thus if the adjustment roller moves in one direction the warp beam is slowed and if moved oppositely it is speeded up until the adjustment roller returns to a desired central position.

The apparatus for winding a warp according to the invention has a first element pivotal on the frame and a second element pivotal on the first element and carrying the adjustment roller. Separate first and second actuators are braced between the elements and the machine frame to take care of the separate and normally mutually perpendicular movements of the adjustment roller.

According to the invention the first element has one end pivoted on the frame and an opposite end connected to the first actuator. The second element is pivoted on the first element intermediate the ends thereof. In addition the second element has one end pivoted on the first element and an opposite end connected to the second actuator. The adjustment roller is pivoted on the second element intermediate the ends thereof.

The second actuator in accordance with this invention includes a rocker pivoted on the frame about a rocker axis, a connecting link having one end connected to the rocker offset from the rocker axis and an opposite end connected to the opposite end of the second element. The ends of the connecting link and the rocker axis are generally in line in the winding position of the adjustment roller. A deflecting roller is provided underneath and parallel to the adjustment roller and warp beam. The path of the warp passes around the deflecting roller between the adjustment roller and the warp beam.

BRIEF DESCRIPTION OF THE DRAWING

The above and other objects, features, and advantages will become more readily apparent from the following description, reference being made to the accompanying drawing whose sole figure is a largely schematic side view of the apparatus according to the invention.

SPECIFIC DESCRIPTION

As seen in the drawing a warp 10 is pulled from a supply 33 and passes horizontally to a pinch roller 20 rotatable on a frame 37 about a horizontal axis. The warp 10 then is pinched by the roller 20 at a location 25 against a transport roller 12 driven by a motor 35 at a substantially constant speed about a horizontal axis, and thence leaves a location 26 offset by almost 270° from the location 25 on the roller 13 to pass through about 180° around an adjustment roller 13 also rotatable about a horizontal axis. The warp 10 leaves a location 27 on the roller 13 and passes straight down to a deflecting roller 24 that it passes under, to be wound up on a horizontal warp beam 11 rotated about a horizontal axis by a motor 34. The roller 24 prevents the changing diameter of the beam 11 from affecting how much of the roller 13 the warp 10 engages.

A main lever 14 is pivoted at 17 on the frame 37 and carries a central pivot 28 for one end 19' of another lever 19 that carries the adjustment roller 13. This lever 14 has an outer end pivoted at 18 to a length-adjustable piston rod 15' of a pneumatic actuating cylinder 15 pivoted on the frame 37. Another pneumatic actuator 16 pivoted at 16' on the frame 37 has a piston rod 16" pivoted at 16'" to one end of a rocker 22 pivoted at 23 on the frame 37. A length-adjustable link rod 20 has one end 20' pivoted at 20" on the rocker 22 opposite to the pivot 16'" and an opposite end 20'" pivoted to an outer end 19" of the second lever 19. A length-adjustable link rod 29 extends from an opposite end 30 of the lever 14 to a crank 31 on a fixed shaft 32. A potentiometer 36 connected to the lever 14 produces an output that corresponds to the position of this element 14 and therefore to the tension in a section 10' of the warp 10 and feeds this output to a controller 21 connected to the motors 34 and 35 as well as to the actuators 15 and 16.

As mentioned above, the motor 35 is operated by the controller 21 to drive the roller 12 at a constant speed. The motor 34 for the beam 11 is driven at an ever decreasing speed, so that the peripheral speed of the beam 11 remains the same even as its diameter increases. If as a result of increased tension in the warp 10 the roller 13 is pulled down against the force applied to it by the actuator 15 which is trying to push it up into its central normal position, this downward movement will be picked up by the potentiometer 36 acting as a warp-tension or roller-position sensor and the controller 21 will slow down the motor 34 and beam 11 slightly. In this winding position shown in the drawing the ends 20' and 20'" of the link rod 20 are virtually aligned with the axis 23 of the rocker 22 which is pressed against an abutment 38 carried on the frame 37 so that the lower end 19" of the element 19 can move vertically but not significantly horizontally.

When the beam 11 is full, the motors 34 and 35 are stopped and the actuator 16 is depressurized and retracted. This action pivots the element 19 and the roller 13 carried on it clockwise about the pivot 28 to press the roller 13 against the roller 12. Thus the warp 10 is pinched between the roller 20 and the roller 12 as well as between the roller 13 and the roller 12, making sure that it will not become disordered. Once thus clamped the warp 10 can be cut near the beam 11 and the thus produced free end can be applied to an empty beam 11. The controller 21 then restarts the motors 34 and 35 with simultaneous monitoring of the position of the roller 13 by the sensor potentiometer 36 to maintain the tension constant even during the critical phase when the cylinder 16 is again pressurized to pull the roller 13 away from the roller 12. Since there are separate actuators 15 and 16 for the two separate mutually perpendicular movements of the roller 13, it is possible to maintain the desired tension control while moving the roller 13 between the illustrated winding position and the unillustrated holding position.

We claim:

1. A method of winding a warp formed of a multiplicity of parallel filaments on a warp beam with an apparatus having:

a supply of the warp;

a transport roller; and an adjustment roller adjacent the transport roller and movable between a holding position engaging the transport roller and a winding position spaced therefrom, the warp extending from the supply along a path around the transport roller, then around the adjustment roller, and then around the warp beam; the method comprising the steps of:

normally rotating the beam and transport roller to displace the warp along the path and wind it up on the beam while maintaining the adjustment roller in the winding position;

detecting tension in the warp at least during winding of the warp on the beam;

during winding of the warp on the beam, displacing the adjustment roller by a first actuator in a predetermined first direction transverse to the path to increase and decrease the tension to maintain the tension within a predetermined range while maintaining the adjustment roller in the winding position;

periodically arresting the beam and transport roller to stop winding of the warp; and while winding is stopped, pressing the adjustment roller by a second actuator separate from the first actuator in a second direction transverse to the first direction against the transport roller into the holding position to pinch the stopped warp between the adjustment roller and the transport roller.

2. The warp-winding method defined in claim 1 further comprising the step of displacing the adjustment roller in the first direction when the adjustment roller is in the holding position.

3. The warp-winding method defined in claim 1, further comprising the steps of:

rotating the transport roller at a generally constant speed during winding of the warp on the beam; and varying a rotation speed of the beam in accordance with the tension detected in the warp.

4. An apparatus for winding a warp formed by a multiplicity of parallel warp filaments up onto a warp beam, the apparatus comprising:

a machine frame;

a transport roller rotatable about a transport axis fixed on the frame adjacent the warp beam;

an adjustment roller rotatable adjacent the transport roller, the warp passing around the transport roller, then around the adjustment roller, and finally around the warp beam;

a first element pivotal on the frame;

a second element pivotal on the first element and carrying the adjustment roller;

means for monitoring the tension in the warp and for generating an output corresponding thereto;

means including a first actuator operatively engaged between the first element and the frame and operable for displacing the adjustment roller in a first direction and thereby varying the tension in the warp;

means including a second actuator operatively engaged between the second element and the frame for displacing the adjustment roller in a first direction transverse to the first direction between a winding position spaced from the transport roller and a holding position engaging the transport roller and pressing the warp thereagainst; and control means connected to both of the actuators and to the monitoring means for actuating the first actuator to maintain the tension in the warp generally constant at all times when the adjustment roller is not in the holding position.

5. The warp-winding apparatus defined in claim 4 wherein the first element has one end pivoted on the frame and an opposite end connected to the first actuator, the second element being pivoted on the first element intermediate the ends thereof.

6. The warp-winding apparatus defined in claim 5 wherein the second element has one end pivoted on the first element and an opposite end connected to the second actuator, the adjustment roller being pivoted on the second element intermediate the ends thereof.

7. The warp-winding apparatus defined in claim 4 wherein the second actuator includes:

a rocker pivoted on the frame about a rocker axis;

a connecting link having one end connected to the rocker offset from the rocker axis and an opposite end connected to the opposite end of the second element, the ends of the connecting link and the rocker axis being generally in line in the winding position of the adjustment roller.

8. The warp-winding apparatus defined in claim 4, further comprising a deflecting roller underneath and parallel to the adjustment roller and warp beam, the path passing around the deflecting roller between the adjustment roller and the warp beam.

* * * * *